US010013921B2

(12) United States Patent
Yamato et al.

(10) Patent No.: US 10,013,921 B2
(45) Date of Patent: Jul. 3, 2018

(54) DISPLAY APPARATUS AND DISPLAY CONTROL CIRCUIT

(71) Applicant: Sharp Kabushiki Kaisha, Osaka-shi, Osaka (JP)

(72) Inventors: Asahi Yamato, Osaka (JP); Fumiyuki Kobayashi, Osaka (JP); Hikaru Kuki, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 49 days.

(21) Appl. No.: 14/891,901

(22) PCT Filed: Feb. 25, 2014

(86) PCT No.: PCT/JP2014/054543
§ 371 (c)(1),
(2) Date: Nov. 17, 2015

(87) PCT Pub. No.: WO2014/188750
PCT Pub. Date: Nov. 27, 2014

(65) Prior Publication Data

US 2016/0111047 A1 Apr. 21, 2016

(30) Foreign Application Priority Data

May 22, 2013 (JP) ..... 2013-108432

(51) Int. Cl.
*G09G 3/34* (2006.01)
*G09G 3/36* (2006.01)

(52) U.S. Cl.
CPC ..... *G09G 3/3406* (2013.01); *G09G 3/3611* (2013.01); *G09G 3/3614* (2013.01);
(Continued)

(58) Field of Classification Search
CPC ..... G09G 3/3406; G09G 3/3614; G09G 2320/0646; G09G 2320/0247; G09G 2300/0823
See application file for complete search history.

(56) References Cited

U.S. PATENT DOCUMENTS

2002/0093473 A1 7/2002 Tanaka et al.
2005/0184952 A1 8/2005 Konno et al.
(Continued)

FOREIGN PATENT DOCUMENTS

JP 2002-278523 A 9/2002
JP 2005-258403 A 9/2005
(Continued)

OTHER PUBLICATIONS

Official Communication issued in International Patent Application No. PCT/JP2014/054543, dated Jun. 10, 2014.

*Primary Examiner* — Dennis Joseph
(74) *Attorney, Agent, or Firm* — Keating & Bennett, LLP

(57) ABSTRACT

A display apparatus and a display control circuit which may contain an occurrence of the inappropriate brightness, such as flickering, at the time of pausing driving are provided. A scan period (St1, St2) during which a display panel drive device scans a display panel device and a retention period (Vt1) during which the display panel drive device does not scan the display panel device alternate and a timing control device causes the display panel drive device to scan the display panel device a plurality of times in the scan period when at least the brightness (Lb1) of the backlight device is changed.

10 Claims, 11 Drawing Sheets

(52) U.S. Cl.
CPC ... *G09G 3/3648* (2013.01); *G09G 2320/0247* (2013.01); *G09G 2320/0646* (2013.01); *G09G 2360/16* (2013.01)

(56) References Cited

U.S. PATENT DOCUMENTS

| | | | | |
|---|---|---|---|---|
| 2009/0115907 | A1 | 5/2009 | Baba et al. | |
| 2010/0163874 | A1* | 7/2010 | Koyama | H01L 27/12 257/57 |
| 2012/0026215 | A1* | 2/2012 | Takeuchi | G09G 3/3614 345/691 |
| 2012/0086689 | A1* | 4/2012 | Furuta | G09G 3/3614 345/209 |
| 2012/0138922 | A1 | 6/2012 | Yamazaki et al. | |
| 2013/0155119 | A1* | 6/2013 | Dai | G09G 3/3406 345/690 |
| 2014/0035478 | A1 | 2/2014 | Kitakado et al. | |

FOREIGN PATENT DOCUMENTS

| | | | |
|---|---|---|---|
| JP | 2009-109900 | A | 5/2009 |
| JP | 2012-134475 | A | 7/2012 |
| WO | 2012/117936 | A1 | 9/2012 |

* cited by examiner

DISPLAY APPARATUS AND DISPLAY CONTROL CIRCUIT

TECHNICAL FIELD

The present invention relates to a display apparatus and a display control circuit. This application claims priority from Japanese Patent Application No. 2013-108432, filed in Japan on May 22, 2013; the entire contents of which are incorporated herein by reference.

BACKGROUND ART

Conventionally, in liquid crystal display apparatuses, an active backlight technique is used which processes backlight and video data in line with video data and reduces power consumption. The liquid crystal display apparatuses which use the active backlight technique include those which performs a dimming process in which the brightness of the backlight is gradually changed in order to prevent flickering due to the backlight brightness changing rapidly (Patent document 1, for example). Moreover, the liquid crystal display apparatuses include those in which a retention period is provided during which scanning is not performed in between scanning (also called refreshing) on a liquid crystal panel to perform pausing driving which reduces the rate of scanning for the purpose of reduction of power consumption, etc.

CITATION LIST

Patent Document

[PATENT DOCUMENT 1] JP2005-258403A

DISCLOSURE OF THE INVENTION

Problems to be Solved by the Invention

However, in Patent document 1, there is a problem that, while an occurrence of the inappropriate brightness such as flickering may be prevented by the dimming process, pausing driving may not be performed.

The present invention, which is conceived in light of such circumstances, is to provide a display apparatus and a display control circuit which make it possible to contain an occurrence of the inappropriate brightness such as flickering at the time of pausing driving.

Means for Solving the Problems (1) The present invention has been conceived to solve the above-described problems. In an embodiment of the present invention is provided a display apparatus, including a backlight device which emits a light; a backlight drive device which drives the backlight device; a display panel device which controls a transmittance of the light emitted by the backlight device at least for each pixel; a display panel drive device which scans the display panel device to cause the transmittance to be controlled; a timing control device which controls timing at which the display panel drive device scans the display panel device and a brightness of the backlight drive device, wherein a scan period during which the display panel drive device scans the display panel device and a retention period during which the display panel drive device does not scan the display panel device alternate; and the timing control device causes the display panel drive device to scan the display panel device a plurality of times in the scan period when it changes at least the brightness of the backlight device.

(2) Moreover, in another embodiment of the present invention, the display apparatus as recited in (1) is provided, wherein the timing control device controls the backlight drive device such that the brightness of the backlight device does not change at the time of a first scan and changes at the time of a second scan of the plurality of times of scans.

(3) Furthermore, in a further embodiment of the present invention, the display apparatus as recited in (1) is provided, wherein the timing control device controls the backlight drive device such that the brightness of the backlight device changes gradually in the plurality of time of scans.

(4) Moreover, in a yet further embodiment of the present invention, the display apparatus as recited in (1) is provided, wherein the timing control device controls the display panel drive device such that the display panel device is scanned the number of times that is less than the plurality of times in the scan period when the brightness of the backlight device is not changed.

(5) Furthermore, in another embodiment of the present invention, the display apparatus as recited in (4) is provided, wherein the timing control device sets a length of a period including the scan period and the following retention period to be constant.

(6) Moreover, in a further embodiment of the present invention, the display apparatus as recited in (4) is provided, wherein the timing control device controls the display panel drive device such that polarity conversion is performed for each period including a scan period and the following retention period and is not performed for each scan during the plurality of times of scans.

(7) Furthermore, in a further embodiment of the present invention, the display apparatus as recited in any one of (1) to (6) is provided, wherein the display panel device has a thin film transistor; and the thin film transistor is made of an oxide semiconductor. (8) Moreover, in a yet further embodiment of the present invention, the display apparatus as recited in (7) is provided, wherein the oxide semiconductor includes In, Ga, Zn, and O. (9) Furthermore, in another embodiment of the present invention, the display apparatus as recited in (8) is provided, wherein the oxide semiconductor including In, Ga, Zn, and O has a crystallizing property.

(10) Moreover, in a further embodiment of the present invention is provided a display control circuit which controls a backlight drive device which drives a backlight device which emits a light and a display panel drive device which scans the display panel device to cause an amount of transmittance of the light emitted by the backlight device to be controlled, the display control circuit further including a timing control device which causes the display panel drive device to scan the display panel device a plurality of times in a scan period in which the display panel drive device scans the display panel device when at least the brightness of the backlight device is changed, wherein the scan period and a retention period in which the display panel drive device does not scan the display panel device alternate.

Effects of the Invention

One embodiment of the present invention makes it possible to contain an occurrence of the inappropriate brightness such as flickering, at the time of pausing driving.

MODE FOR CARRYING OUT THE INVENTION

First Embodiment

Embodiments of the present invention are explained with reference to the drawings.

Figure 1:
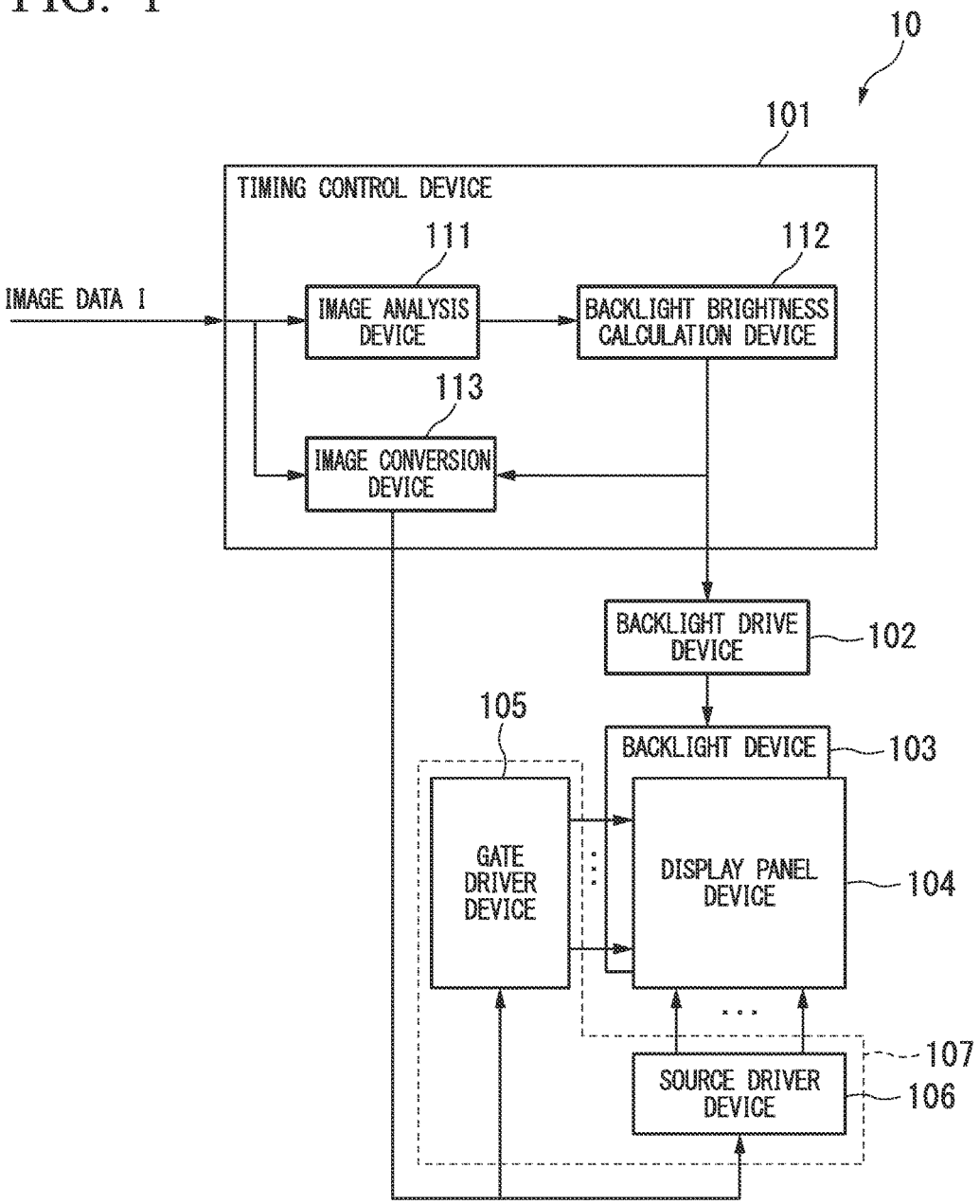
FIG. 1 is a schematic block diagram illustrating a configuration of a liquid crystal display apparatus 10 according to a first embodiment of the present invention.

FIG. 1 is a schematic block diagram illustrating the configuration of a liquid crystal display apparatus 10 according to a first embodiment of the present invention. The liquid crystal display apparatus 10 performs pausing driving to display thereon an image of image data I input. The liquid crystal display apparatus 10 performs scanning on a below-described display panel device 104 in synchronization with the image data I input.

In other words, the time in which the display panel device 104 is scanned once is the time in which one frame of the image data I is input. Moreover, the pausing driving refers to a driving method in which a scan period which is a period during which the below-described display panel device 104 is scanned (also referred to as being refreshed); and a retention period (scan stop period) which follows the scan period, during which retention period the display panel device 104 is not scanned for at least one sixtieth of a second are set as one period and the one period is repeated. In other words, it is a driving method in which the scan period and the retention period alternate.

In the present embodiment, the length of the scan period is a time period during which two frames of scanning are performed. Below, one time scanning refers to performing one frame of scanning. Moreover, while the length of the retention period in the present embodiment is the same length as that of the time during which five frames of scanning are performed, it may a period of at least one sixtieth of a second, the length thereof being fixed or variable.

Moreover, while the image data I are data on a color image having a red grey scale value, a green grey scale value, and a blue grey scale value of each pixel in the present embodiment, they may be data on a color image having grey scale values of each color of red, green, blue, and a combination of other colors such as yellow, etc. Alternatively, they may be data on a monochrome image which has only one grey scale value for each pixel.

The liquid display apparatus 10 is configured to include a timing control device 101, a backlight drive device 102, a backlight device 103, the display panel device 104, and a display panel drive device 107. Moreover, the timing control device 101 is configured to include an image analysis device 111, a backlight brightness calculation device 112, and an image conversion device 113. The display panel drive device 107 is configured to include a gate driver device 105 and a source driver device 106.

The image analysis device 111 calculates a histogram of grey scale values of a pixel for a first frame of a scan period. The grey scale value of the pixel may be a value which shows the brightness of the pixel. For example, it may be a summed value of the red grey scale value, the green grey scale value, and the blue grey scale of the pixel, or it may be a summed value after multiplying predetermined coefficients to each of the red grey scale value, the green grey scale value, and the blue grey scale value of the pixel, or it may be a maximum value of the red scale value, the green scale value, and the blue scale value of the pixel.

The backlight brightness calculation device 112 refers to the histogram calculated by the image analysis device 111 to calculate the target brightness of the backlight device 103. The backlight brightness calculation device 112 sets the calculated target brightness in the image conversion device 113 and the backlight drive device 102. Determination of the target brightness is performed as follows. First, the backlight brightness calculation device 112 refers to the histogram calculated by the image analysis device 111 to calculate an upper 20% of the grey scale value of the pixel.

The backlight brightness calculation device 112 sets the brightness which is stored in association with the brightness of the backlight device 103 for the individual grey scale values of the scale and which is stored in association with the calculated upper 20% value as a target brightness. In the present embodiment, while the target brightness is calculated using the upper 20% value of the grey scale value of the pixel, other values may be used as long as they are values representing the distribution of the grey scale values of the pixel. For example, other % values such as the upper 10% value may be used, or a maximum value, a mean value, or a median value may be used, or a combination of the mean value and variance may be used.

For first and second frames of the scan period of the image data I input, the image conversion device 113 performs a conversion on grey scale values of each color of each pixel of the frame with reference to the target brightness set by the backlight brightness calculation device 112 and the converted results are reported to the source driver device 106. As described above, the backlight brightness calculation device 112 calculates the target brightness using the first frame of the scan period. Therefore, the image conversion device 113 refers to the target brightness calculated by the backlight brightness calculation device 112 during the previous scan period for conversion on the first frame of the scan period, and refers to the target brightness calculated by the backlight brightness device 112 using the first frame of the scan period for conversion on the second frame of the scan period.

Conversion of the grey scale value of the first and second frames is performed such that a color which is as close to a color is displayed when the backlight device 103 is at the target brightness. For example, the conversion is performed by multiplying a value in which the maximum brightness of the backlight device 103 is divided by the target brightness by the original grey scale value. Moreover, the image conversion device 113 reports the timing at which scanning on the display panel device 104 is started to the gate driver device 105.

The backlight drive device 102 drives the backlight device 103 such that the backlight device 103 emits light at the target brightness reported from the timing control device 101. In the present embodiment, while the backlight drive device 102 adjusts the brightness of the backlight device 103 with the PWM (Pulse Width Modulation), other methods may be used. The backlight device 103 is a light source which emits a white light, such as a combination of a red laser, a green laser, and blue laser; a combination of a red LED (light emitting diode), a green LED, and a blue LED; a white color such as a white LED.

The display panel device 104 includes a liquid display panel and a color filter. Each pixel of the display panel device 104, which includes a red subpixel, a green subpixel, and a blue subpixel, controls the transmittance of the individual subpixels in accordance with a gate signal of the below-described gate driver device 105 and a data signal from the source driver device 106. Controlling the transmittance of all of the subpixels in accordance with the gate signal and data signal is called scanning. When the start of the scanning is reported from the image conversion device 113, a gate signal which specifies a horizontal column (line) of pixels of the display panel device 104 is input to the display panel device 104.

For scanning the display panel device 104, the source driver device 106 inputs a data signal which controls the transmittance of each sub pixel of the display panel device 104 to the display panel device 104 in order of scanning.

Figure 2:
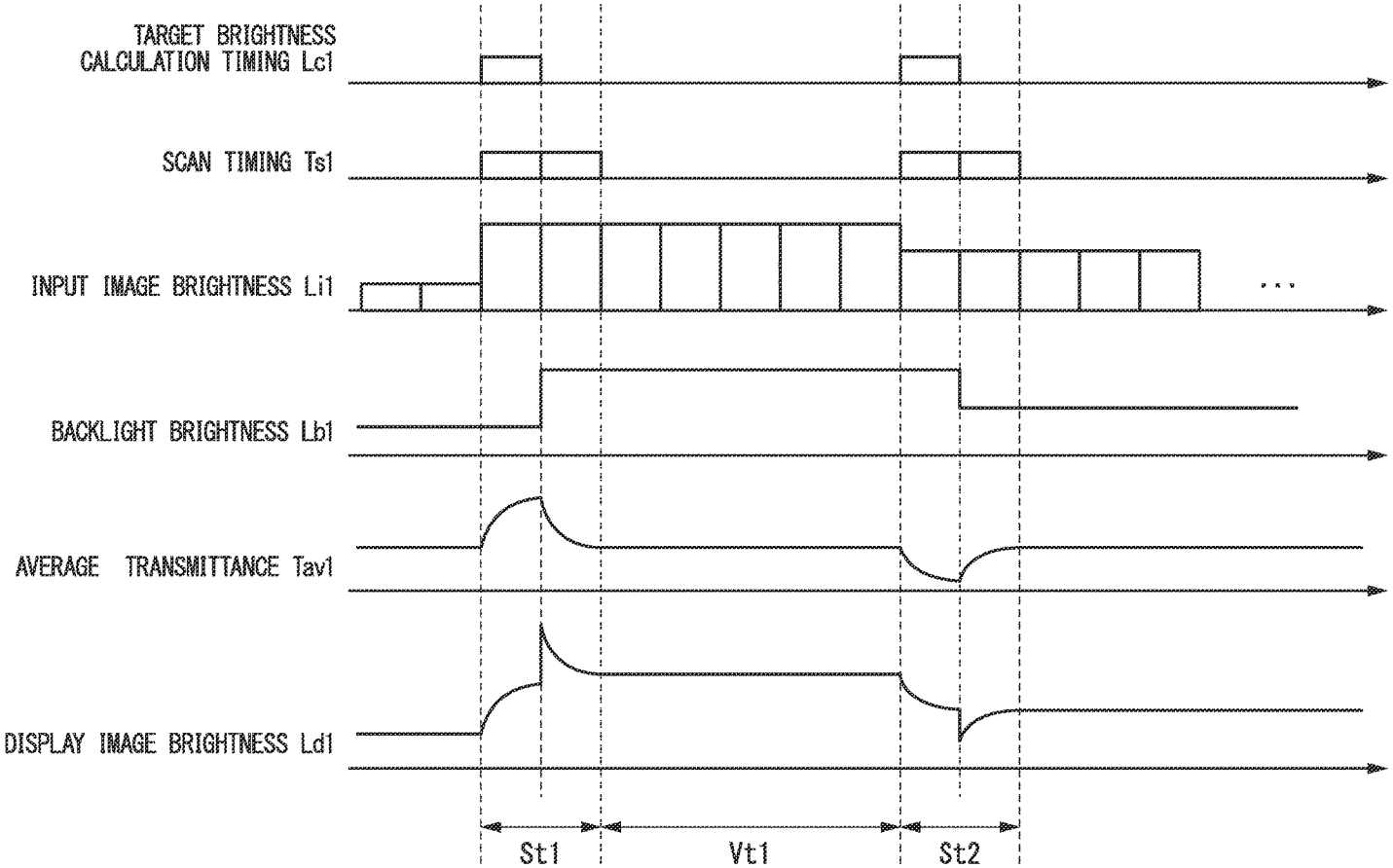
FIG. 2 is a time chart for explaining an operation of the liquid crystal display apparatus 10 according to the above-mentioned embodiment.

FIG. 2 is a time chart for explaining an operation of the liquid crystal display apparatus 10. In FIG. 2, the horizontal axis is time, St1 and St2 are scan periods, and Vt1 is a retention period.

In FIG. 2, the length of the scan period is the same as the time in which two frame are scanned, and the length of the retention period is the same as the time in which five frames are scanned.

The topmost row, or a target brightness calculation timing Lc1, in FIG. 2, indicates the time period during which the image analysis device 111 generates a histogram of the image data I and the backlight brightness calculation device 112 calculates the target brightness. The image analysis device 111 and the backlight brightness calculation device 112 perform a process on the first frame of the scan period, so that such a process is performed in the first half of each of the scan periods St1 and St2.

The second from the topmost row, or a scan timing Ts1, in FIG. 2, indicates the time period in which the gate driver device 105 and the source driver device 106 scan the display panel device 104 in accordance with instructions from the image conversion device 113. Scanning is performed twice each in the scan periods St1 and St2.

The third from the topmost row or the input image brightness Li1 in FIG. 2 is the brightness of each of the frames of the image data I. Here, the brightness of the frame is the mean value of the brightness of all of the pixels which make up the frame. In an example in FIG. 2, the brightness of the first frame of the scan period St1 increases substantially relative to the brightness of the immediately preceding frame and the brightness of the first frame of the scan period St2 decreases relative to the brightness of the immediately preceding frame.

The fourth from the topmost row, or the backlight brightness Lb1, in FIG. 2 is the brightness of the backlight device 103. The backlight drive device 102 drives the backlight device 103 in accordance with the target brightness calculated by the backlight brightness calculation device 112, so that the backlight brightness Lb1 changes from scanning of a frame following the frame for which a change in the input image brightness Li1 occurred. In the example in FIG. 2, the input image brightness Li1 changes from the first frame of each of the scan periods St1 and St2, so that the backlight brightness Lb1 changes from the second scanning of each of the scan periods St1 and St2.

The fifth from the topmost row or the average transmittance Tav1, in FIG. 2 is an average value of the transmittance of all subpixels of the display panel device 104. In the example in FIG. 2, the input image brightness Li1 changes from the first frame of each of scan periods St1 and St2, and the backlight brightness Lb1 changes from scanning for the second frame. Thus, the average transmittance Tav1 in the scan period St1 increases as scanning progresses in the first scan and decreases as the scanning progresses in the second scan. Moreover, the average transmittance Tav1 in the scan period St2 decreases with the progress of scanning in the first scan and increases as the scanning progresses in the second scan.

The sixth from the topmost row or the display image brightness Ld1 in FIG. 2 is the brightness of a frame displayed by the liquid crystal display apparatus 10. The display image brightness Ld1 is the brightness of what is transmitted by the display panel device 104 out of lights emitted by the backlight device 103, so that it takes a product of the backlight brightness Lb1 and the average transmittance Tav1.

Therefore, in an example in FIG. 2, the display image brightness Ld1, in the first scan of the scan period St1, increases with the progress of the scanning, increases in accordance with an increase in the backlight brightness Lb1 at the beginning of the second scanning and decreases with the progress of the scanning. Moreover, the display image brightness Ld1 decreases with the progress of the scanning in the first scanning of the scan period St2, decreases in accordance with a decrease of the backlight brightness Lb1, and increases with the progress of the scanning in the second scanning.

While FIG. 2 only shows an example in which the target brightness calculated by the backlight brightness calculation device 112 changes from the previous value thereof, when the target brightness is the same as the previous value, the brightness of the backlight device 103 does not change. Thus, the display image brightness Ld1 undergoes a change similar to the average transmittance Tav1.

Moreover, while it has been explained in the present embodiment that the image data I are also input during the retention period, they may be arranged to be input only during the scan period, so that input is prevented during the retention period, or only some signals such as a vertical synchronization signal, etc., for example, of the image data I may be input. Alternatively, it may be arranged for the timing control device 101 to request an input source of the image data I to input the image data I.

Furthermore, while it is desirable in the present embodiment that two frames in the individual scan periods be the same image in the image data I, they do not have to be the same as long as the difference therebetween is such that changing the backlight brightness is not required.

Furthermore, while the image analysis device 111 generates a histogram for only the first frame of the scan period to set the timing for changing the brightness of the backlight device 103 to within the scan period in the present embodiment, it may be arranged for the timing which changes the brightness of the backlight device 103 to be within the scan period with a different method. For example, while the image analysis device 111 generates a histogram for all of the frames, it may be arranged for the backlight brightness calculation device 112 to report the target brightness to the backlight drive device 102 only during the scan period.

Figure 3:
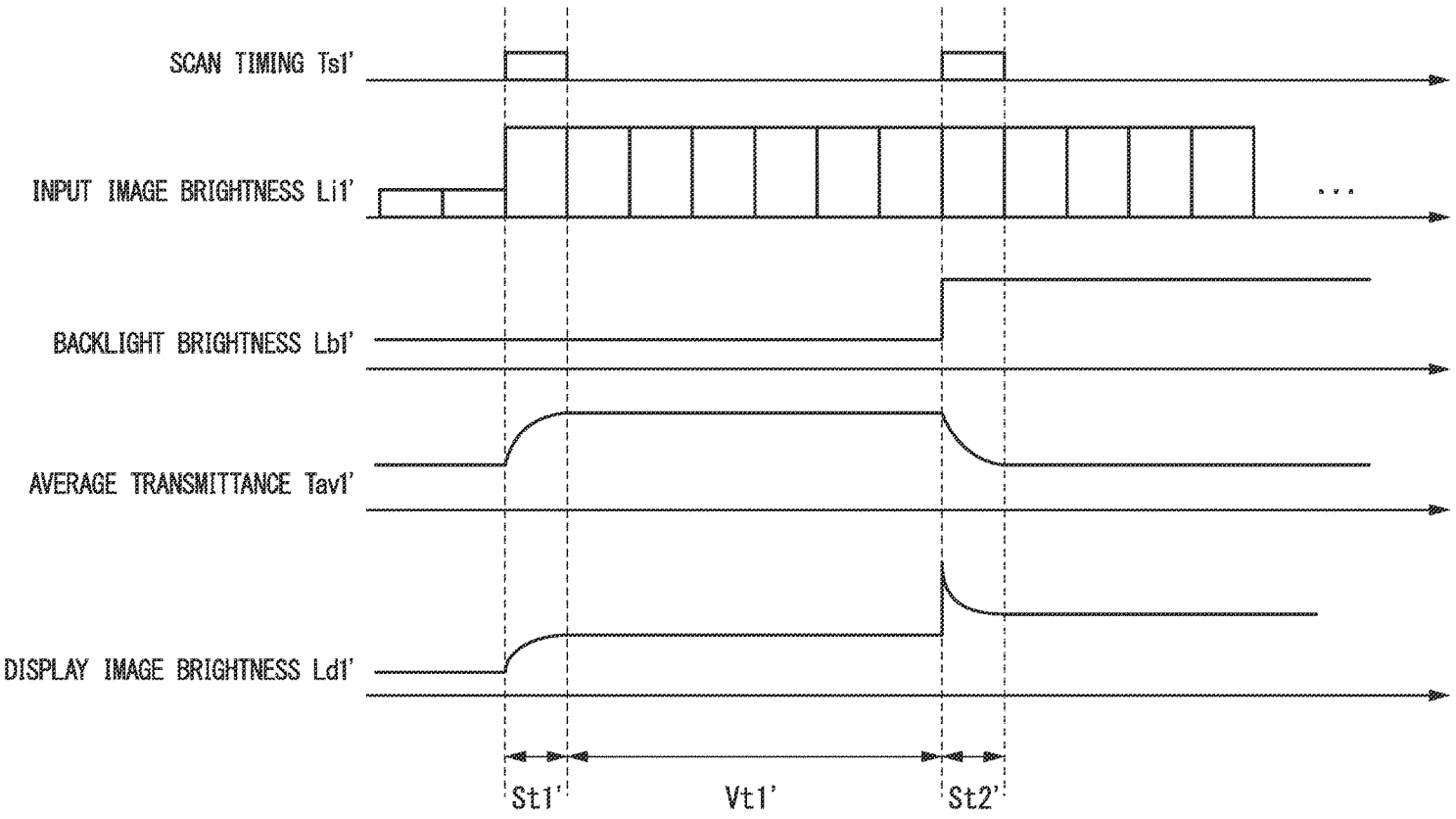
FIG. 3 is a time chart of a comparative example according to the above-mentioned embodiment.

FIG. 3 is a time chart of a comparative example. In the comparative example in FIG. 3, scanning is performed only once as indicated with the scan timing Ts1' in the scan period. Therefore, when the input image brightness Li1' increases at the start of the scan period St1', the backlight brightness Lb1' increases from the scan period St2' following the retention period Vt1', which follows the scan period St1'. While the average transmittance Tav1' increase in the scan period St1', the backlight brightness Lb1' is low, causing a state such that the brightness sufficient as the brightness of the display image brightness Ld1' is not obtained until reaching the scan period St2' to occur.

However, in the present embodiment, as shown in FIG. 2, scanning may be performed at least twice in the scan period to change the backlight brightness at the time of the second scanning and to set the transmittance of the display panel device 104 to be suitable for the backlight brightness. Therefore, the time period during which the backlight brightness does not match the target brightness may be contained to within the scan period and an inappropriate state such that the picture quality is being degraded due to the brightness of the backlight being too low, or alternatively, power consumption is large due to the brightness of the backlight being too high may be contained to a very short time such as only during the first scan of the scan period.

Second Embodiment

Figure 4:
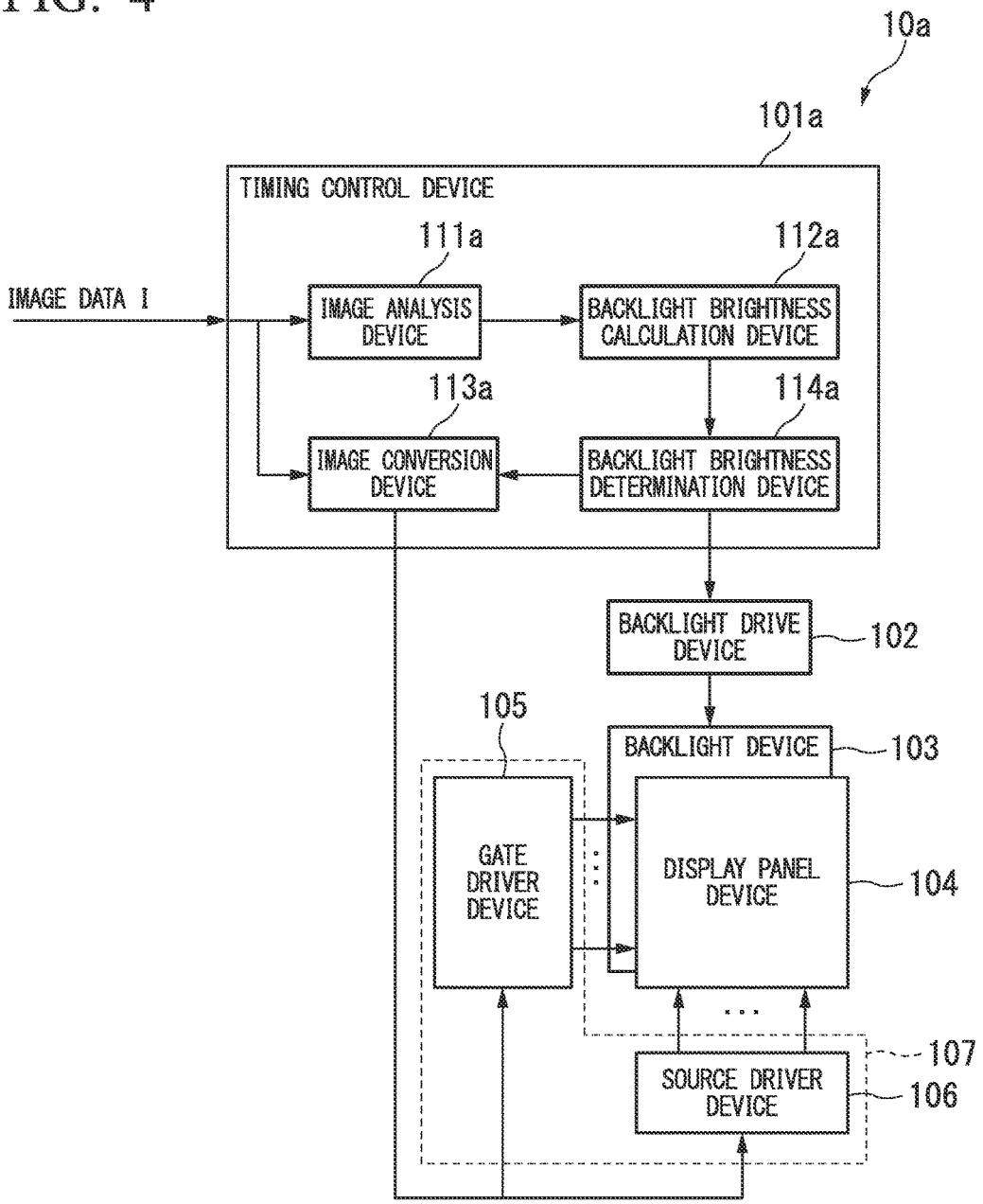
FIG. 4 is a schematic block diagram illustrating a configuration of a liquid crystal display apparatus 10*a* according to a second embodiment of the present invention.

While the first embodiment is an embodiment which performs scanning twice in the scan period and changes the backlight brightness at the start of the second scan, the second embodiment as described below is an embodiment which performs a dimming process within the scan period. FIG. 4 is a schematic block diagram illustrating a configuration of the liquid crystal display apparatus 10*a* according to the second embodiment of the present invention. In FIG. 4, the same letters (102-107) are given to parts corresponding to each device in FIG. 1, so that explanations are omitted. In the same manner as the liquid crystal display apparatus 10 in FIG. 1, the liquid crystal display apparatus 10*a* also performs pausing driving to display thereon an image of the image data I input. Moreover, the liquid display apparatus 10*a* also performs scanning of the display panel device 104 in synchronization with the image data I input.

The liquid display apparatus 10*a* is configured to include a timing control device 101*a*, a backlight drive device 102, a backlight device 103, a display panel device 104, a gate driver device 105, and a source driver device 106. Moreover, the timing control device 101*a* is configured to include an image analysis device 111*a*, a backlight brightness calculation device 112*a*, an image conversion device 113*a*, and a backlight brightness determination device 114*a*.

The image analysis device 111*a* calculates a histogram of gray scale values of a pixel for each of the first to the third frames of the scan period. The backlight brightness calculation device 112*a* refers to the histogram calculated by the image analysis device 111*a* to calculate the target brightness of the backlight device 103 for the individual histograms. The backlight brightness calculation device 112*a* inputs the calculated target brightness to the backlight brightness determination device 114*a*.

The backlight brightness determination device 114*a* gradually changes the brightness of the backlight device 103 for each second-and-thereafter scan within the scan period such that the brightness of the backlight device 103 in the final scan of the scan period would reach the target brightness calculated by the backlight brightness calculation device 112. Below, the gradually changed brightness is called the control brightness. The backlight brightness determination device 114*a* sets the control brightness in place of the target brightness in the backlight drive device 102 and the image conversion device 113*a*.

For example, the backlight brightness determination device 114*a* calculates the control brightness as follows. When the brightness of the backlight device 103 at the start of the scan period is $L_0$, the target brightness calculated from the histogram of the x-th frame is Lt(x), and the number of times of scans within the scan period is N, the backlight brightness determination device 114*a* uses Equation (1) to calculate the control brightness Ln at the time of starting the n-th scan within the scan period (where n is $2 \leq n \leq N$).

$$L_n=(n-1)\times(Lt(n-1)-L_0)/(N-1)+L_0 \quad \text{Equation (1)}$$

In the present embodiment, the number of times of scans N within the scan period is 4. Moreover, the brightness $L_0$ of the backlight device 103 at the time of the start of the scan period uses the control brightness of the last frame of the previous scan period.

For the individual frames within the scan period of image data I input, the image conversion device 113*a* performs a conversion on the grey scale value of each color of the individual pixels of the frame with reference to the control brightness $L_n$ set by the backlight brightness determination device 114*a* and reports the converted results to the source driver device 106. For conversion on the first frame of the scan period, the control brightness of the final frame of the previous scan period is used.

The same process performed by the image conversion device 113 in FIG. 1 is also performed by the image conversion device 113*a* such that a color which is as close as possible to the color exhibited by the original grey scale value is displayed when the backlight device 103 is at the control brightness. For example, the conversion is performed by multiplying a value in which the maximum brightness of the backlight device 103 is divided by the control brightness by the original grey scale value. Moreover, the image conversion device 113*a* reports the timing at which scanning on the display panel device 104 is started to the gate driver device 105.

Figure 5:
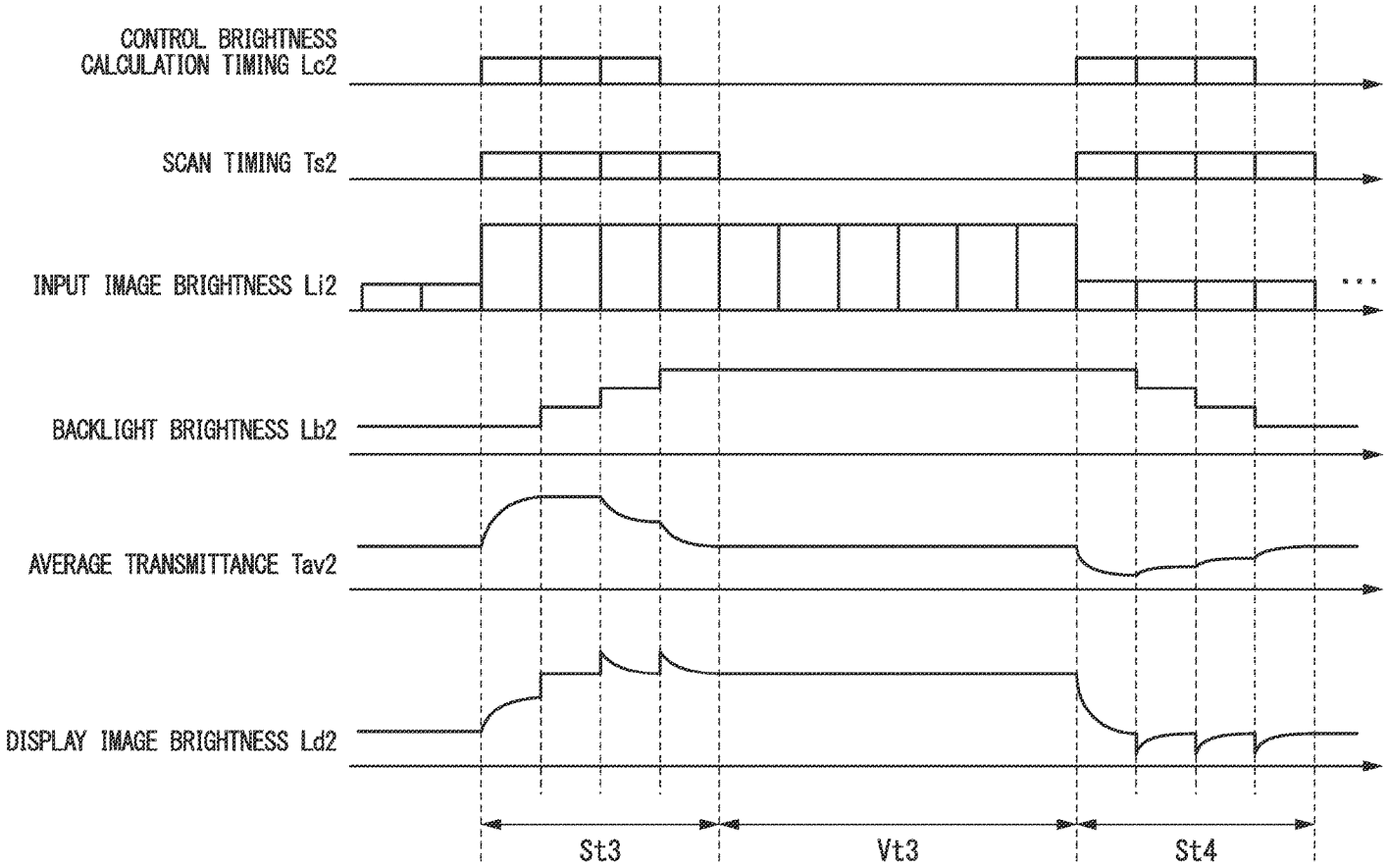
FIG. 5 is a time chart for explaining an operation of the liquid crystal display apparatus 10*a* according to the above-mentioned embodiment.

FIG. 5 is a time chart for explaining an operation of the liquid crystal display apparatus 10*a*. In FIG. 5, the horizontal axis is time, St3 and St4 are scan periods, and Vt3 is a retention period. In FIG. 5, the length of the scan period is the same as the time for scanning four frames, while the length of the retention period is the same as the time for scanning six frames.

The top row in FIG. 5, or the control brightness calculation timing Lc2, indicates the time period during which the process of calculating the control brightness is performed by the image analysis device 111*a*, the backlight device calculation device 12*a*, and the backlight device 114*a*. The control brightness is calculated from each of the first to third frames within the scan period, so that, in an example in FIG. 5, the above-described process is performed in each of the first to third scan periods of each of the scan periods St3 and St4.

The second from the top row in FIG. 5, or the scan timing Ts2, indicates the time period during which the gate driver device 105 and the source driver device 106 scan the display panel device 104 in accordance with instructions from the image conversion device 113*a*. Scanning is performed four times in each of the scan periods St3 and St4.

The third from the top row in FIG. 5, or the input image brightness Li2, is the brightness of each of frames of image data I. Here, the brightness of the frame is the average value of the brightness of all pixels which make up the frame. In an example of FIG. 5, the brightness of the first frame of the scan period St3 increases such that it is greater than the brightness of the preceding frame and the brightness of the first frame of the scan period St4 decreases such that it is less than the brightness of the immediately preceding frame.

The fourth from the top row in FIG. 5, the backlight brightness Lb2 is the brightness of the backlight device 103. The backlight drive device 102 drives the backlight device 103 in accordance with the control brightness calculated by the backlight brightness determination device 114*a*, so that the backlight brightness Lb2 changes from the following frame of the frame in which a change occurred in the input image brightness Li2. In the example in FIG. 5, the input image brightness Li2 changes from the first frame of each of the scan periods St3 and St4, so that the backlight brightness Lb2 gradually changes from the second frame of each of the scan periods St3 and St4.

The fifth from the top row in FIG. 5, the average transmittance Tav2 is an average value of transmittance of all sub-pixels of the display panel device 104. In the example in FIG. 5, the input image chrominance Li2 changes from the first frame of each of the scan periods St3 and St4 and the backlight brightness Lb2 gradually changes from scanning of the second frame. The average transmittance Tav2 in the scan period St3 increases as scanning progresses in the first scan. In the second scan, the backlight brightness Lb2 increases at the start of scanning, but the magnitude is not yet sufficient, so that the average transmittance Tav2 does not change. In the third-and-thereafter scans, the background brightness Lb2 increases at the start of the individual scans, so that the average transmittance Tav2 decreases as the scanning progresses.

Moreover, as the backlight brightness Lb2 is large in the first scan, the average transmittance Tav2 in the scan period St4 is large, so that it decreases with the progress of scanning. However, in the second-and-thereafter scans, backlight brightness Lb2 decreases at the start of the individual scans, so that the average transmittance Tav2 increases with the progress of scanning.

The sixth from the top row in FIG. 5, the display image brightness Ld2 is the brightness of the frame displayed by the liquid crystal display apparatus 10*a*. The display image brightness Ld2 is the brightness by what transmitted the display panel device 104 of lights emitted by the backlight device 103, so that it takes a product of the backlight brightness Lb2 and the average transmittance Tav2.

Therefore, in the example in FIG. 5, the display image brightness Ld2 increases with the progress of scanning in the first scan of the scan period St3, and increases in accordance with an increase of the backlight brightness Lb2 at the start of the second scan, so that it does not change with the progress of the scanning in the second scan. Moreover, in the third and fourth scans, it increases with an increase of the backlight brightness Lb2 at the start of each scan and decreases with the progress of each scan.

Moreover, in the first scan of the scan period St4, the display image brightness Ld2 decreases with the progress of the scanning. In each of the second-and-thereafter scans, the display image brightness Ld2, at the start of each scan, decreases in accordance with the decrease of the backlight brightness Lb2 and increases with the progress of the scan.

While FIG. 5 shows only an example in which the control brightness calculated by the backlight brightness determination device 114*a* changes from the previous value, the brightness of the backlight device 103 does not change when the control brightness has the same value as the previous value. Therefore, the display image brightness Ld2 changes in the same manner as the average transmittance Tav2.

Moreover, while the image analysis device 111*a* is described as generating a histogram for each of the first to the third frames of the scan period, the histogram may be generated for only the first frame within the scan period in the same manner as the image analysis device 111 in FIG. 1. Furthermore, in this case, in the same manner as the backlight brightness calculation device 112 in FIG. 1, it may be arranged for the backlight brightness calculation device 112*a* to calculate the target brightness only once within the scan period and for the backlight brightness determination device 114*a* to calculate the control brightness using the target brightness.

Furthermore, while the number of times of scans within the scan period is set to be four times in the present embodiment, it may be set to be the number of times in which the backlight brightness may be changed gradually, in other words, at least three times.

Moreover, while it is explained that the image data I are also input in the retention period in the present embodiment, it may be arranged for the image data I to be input only during the scan period and not input during the retention period, or only some signals such as a vertical synchronization signal, for example, out of the image data I may be input in the retention period.

Furthermore, while it is desired in the present embodiment that all frames are for the same image in each of the scan periods in the image data I, but they do not have to be the same as long as the difference therebetween does not necessitate changing the backlight chrominance.

In the present embodiment, as shown in FIG. 5, in each scan period, scan is performed four times, so that the backlight brightness may be gradually changed for each scan. This eliminates a rapid change of the backlight brightness, making it possible to prevent the viewer from feeling flickering.

Moreover, the backlight brightness may contain the time period which does not correspond to the target brightness to within the scan period. Therefore, an inappropriate state such the image quality is being degraded due to the backlight brightness being too low, or, alternatively, the power consumption is large due to the backlight brightness being too high may be contained to a short time of within the scan period.

Third Embodiment

Figure 6:
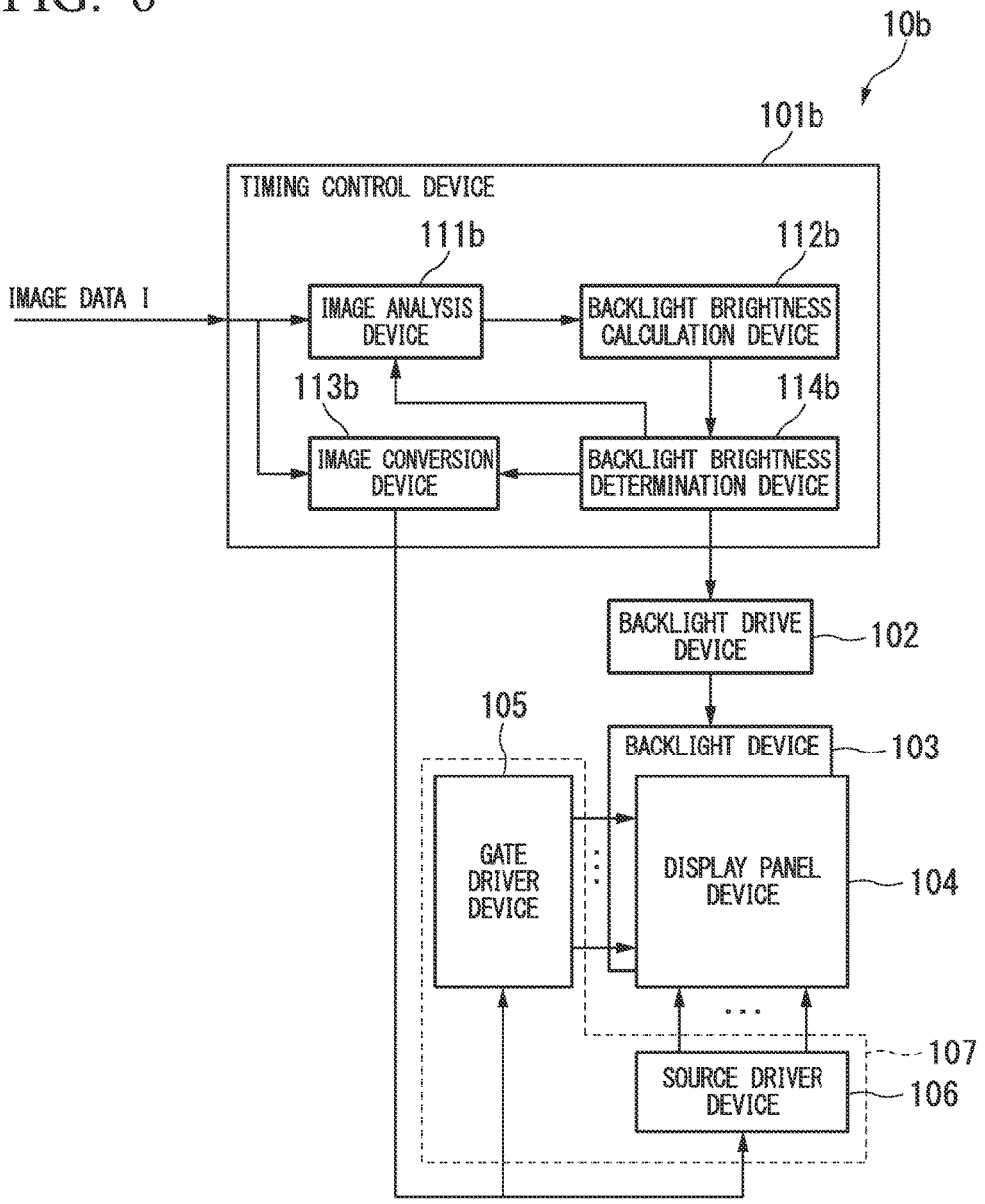
FIG. 6 is a schematic block diagram illustrating a configuration of a liquid crystal display apparatus 10*b* according to a third embodiment of the present invention.

While the second embodiment is an embodiment in which the number of times of scans in all of the scan periods is constant, the third embodiment described below is an embodiment in which the number of scans is set to be a plurality only in the scan period in which an image changes and the backlight brightness is changed. FIG. 6 is a schematic block diagram illustrating a configuration of a liquid crystal display apparatus 10*b* according to a third embodiment of the present invention. In FIG. 6, the same letters (102-107) are given to parts corresponding to the individual devices in FIG. 1, so that explanations are omitted. In the same manner as the liquid crystal display apparatus 10, the liquid display device 10*b* also performs pausing driving to display an image of the image data I input. Moreover, the liquid crystal display apparatus 10*b* also performs scanning of the display panel device 104 in synchronization with the image data I input.

The liquid crystal display apparatus 10*b* is configured to include a timing control device 101*b*, a backlight drive device 102, a backlight device 103, a display panel device 104, a gate driver device 105, and a source driver device 106. Moreover, the timing control device 101*b* is configured to include an image analysis device 111*b*, a backlight brightness calculation device 112*b*, an image conversion device 113*b*, and a backlight brightness determination device 114*b*.

When the brightness of the backlight device 103 is changed in the scan period, the image analysis device 111*b* calculates the histogram of the grey scale value of the pixel for each of the first to third frames of the scan period. Moreover, when the brightness of the backlight device 103 in the scan period is not changed, the image analysis device 111*b* calculates the histogram of the grey scale value of the pixel for only the first frame of the scan period and completes the scan period.

While the image analysis device 111*b* is reported from the backlight brightness determination device 114*b* on whether the brightness of the backlight device 103 is reported in the present embodiment, it may be arranged for it to be reported from a different device or it may be determined by the image analysis device 111*b*. Moreover, when the brightness of the backlight device 103 is changed in the scan period, the scan period corresponds to four frames, while the retention period which follows corresponds to six frames. When the brightness of the backlight device 103 is not changed in the scan period, the scan period corresponds to one frame, while the retention period which follows corresponds to nine frames. In other words, the sum (one period) of the length of the scan period and the length of the retention period which follows is constant and corresponds to 10 frames.

The backlight brightness calculation device 112*b* refers to the histogram calculated by the image analysis device 111*b* to calculate the target brightness of the backlight device 103. The backlight brightness calculation device 112*b* inputs the calculated target brightness to the backlight brightness determination device 114*b*. In other words, when the brightness of the backlight device 103 is changed, the backlight brightness calculation device 112*b* calculates the target brightness from each of the first to third frames of the scan period and, when the brightness of the backlight device 103 is not changed, the backlight brightness calculation device 112*b* calculates the target brightness from only the first frame of the scan period.

The backlight brightness determination device 114*b* refers to the target brightness calculated by the backlight brightness calculation device 112*b* to calculate the control brightness using Equation (1) in the same manner as the backlight brightness determination device 114*a* and sets the calculated control brightness in the backlight drive device 102 and the image conversion device 113*b*. The backlight brightness determination device 114*b* compares the target brightness calculated from the first frame of the scan period with the control brightness which is currently set in the backlight drive device 102 and determines whether to change the brightness of the backlight device 103 in the scan period.

For example, as a result of the comparison, when these values do not match it is determined that the image has changed, so that it is necessary to change the brightness of the backlight device 103, while, when they match, it is determined that the image has not changed, so that it is not necessary to change the brightness of the backlight device 103. Alternatively, as a result of the comparison, when the difference of the target brightness and the control brightness is larger than the predetermined threshold, it is determined that the image changes and there is a need to change, while, when the difference of the target brightness and the control brightness is smaller than the predetermined threshold, it is determined that the image has not changed and there is no need to change.

The backlight brightness determination device 114*b* reports the results of determination to the image analysis device 111*b* and the image conversion device 113*b* before the second frame of the scan period is input to an own device.

In the same manner as the image conversion device 113 in FIG. 1, the image conversion device 113*b* converts, for each of all of the frames within the scan period of the image data I input, the grey scale value of each color of individual pixels of the frame with reference to the control brightness $L_n$ set by the backlight brightness determination device 114*b* and reports the converted results to the source driver device 106. For conversion on the first frame of the scan period, the control brightness of the last frame of the previous scan period is used. Moreover, the image conversion device 113*b* reports the timing which starts scanning on the display panel device 104 to the gate driver device 105.

After conversion on the first frame of the scan period, the image conversion device 113*b* receives a report on whether it is necessary to change the brightness of the backlight device 103 from the backlight brightness determination device 114*b*, and, when it receives a report that it is not necessary to change, the scan period is terminated and, until the next scan period arrives, conversion of the grey scale value is not performed and reporting to the gate driver device 105 and the source driver device 106 is not performed. Moreover, when it receives a report that it is necessary to change, conversion of the grey scale value and reporting to the gate driver device 105 and the source driver device 106 are performed until the fourth frame.

Figure 7:
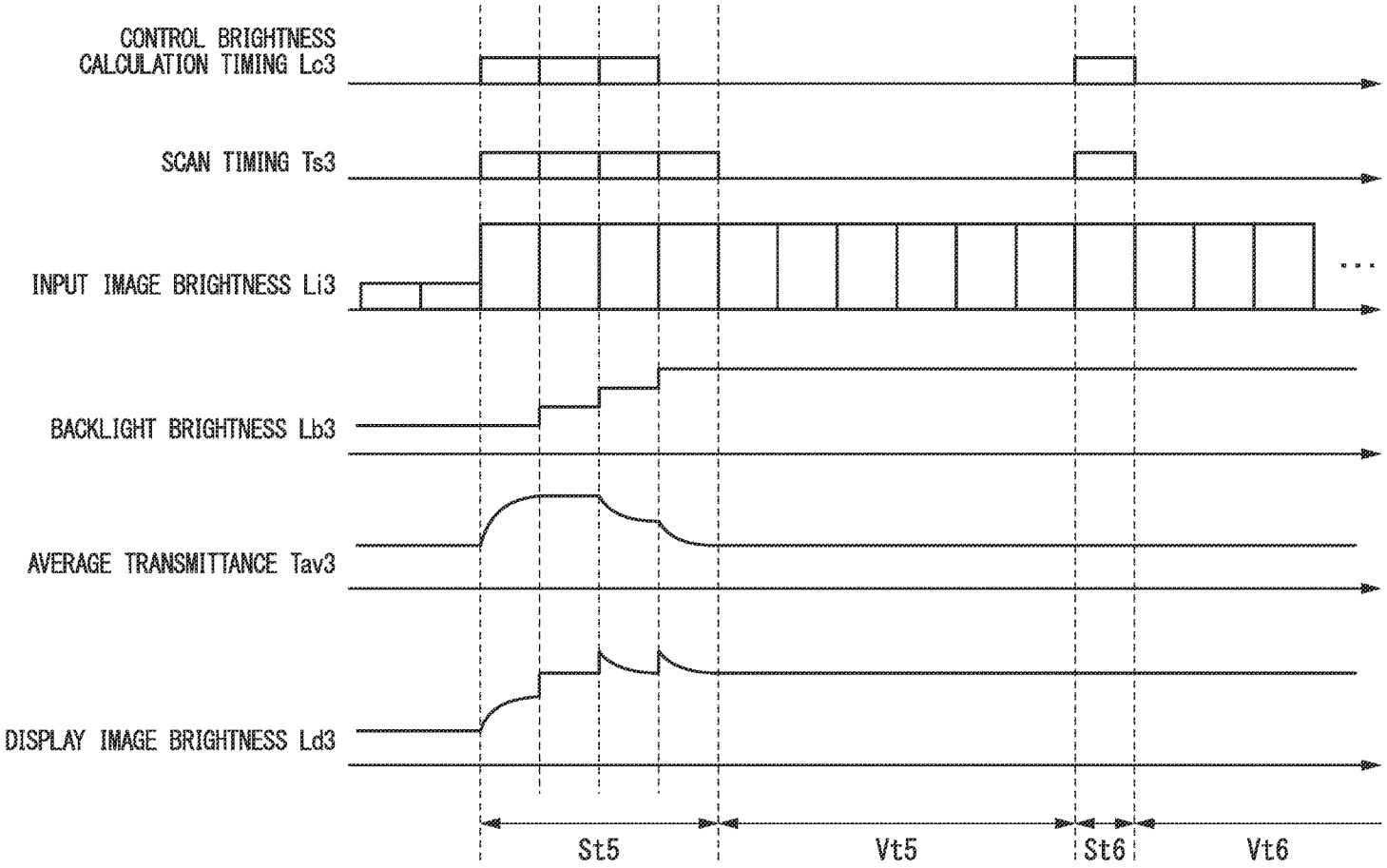
FIG. 7 is a time chart for explaining an operation of the liquid crystal display apparatus 10*b* according to the above-mentioned embodiment.

FIG. 7 is a time chart which describes an operation of the liquid crystal display apparatus 10*b*. In FIG. 7, the horizontal axis is time, St5 and St6 are scan periods, and Vt5 and Vt6 are retention periods. In FIG. 7, the scan period St5 is a scan period which changes the brightness of the backlight device 103, while the scan period St6 is a scan period which does not change the brightness of the backlight device 103. Therefore, the scan period St5 is the same as the time in which four frames are scanned and the length of the retention period Vt5 is the same as the time in which six frames are scanned. Moreover, the length of the scan period St6 is the same as the time which in which one frame is scanned. In FIG. 7, while the end of the retention period Vt6 is not shown, one period corresponds to 10 frames, so that the length of the retention period Vt6 is the same as the time in which nine frames are scanned.

The top row in FIG. 7, or the target brightness calculation timing Lc3 indicates the time period in which the image analysis device 111*b* generates the histogram and the backlight brightness calculation device 112*b* calculates the target brightness and the backlight brightness determination device 114*b* calculates the control brightness. In the scan period St5, the image analysis device 111*b*, the backlight brightness calculation device 112*b*, and the backlight brightness determination device 114*b* performs a process on each of the first to the third frames of the scan period. However, the scan period St6 only corresponds to one frame, so that these individual devices perform the process on only the first frame of the scan period.

The second row from the top in FIG. 7, the scan timing Ts3 shows the time period in which the gate driver device 105 and the source driver device 106 scan the display panel device 104 in accordance with instructions from the image conversion device 113*b*. In the scan period St5, scanning is performed four times and, in the scan period St6, scanning is performed once.

The third row from the top in FIG. 7, the input image brightness Li3 is the brightness of the individual frames of the image data I. In an example in FIG. 7, the brightness of the first frame in the scan period St5 increases such that it is greater than the immediately-preceding frame, and thereafter there is no change.

The four row from the top in FIG. 7, the backlight brightness Lb3 is the brightness of the backlight device 103. The backlight drive device 102 drives the backlight device 103 in accordance with the control brightness calculated by the backlight brightness determination device 114*b*, so that the backlight brightness Lb3 gradually increases from scanning of the frame following the frame in which a change occurs in the input image brightness Li3.

The fifth row from the top in FIG. 7, the average transmittance Tav3 is the average value of the transmittance of all of the subpixels of the display panel device 104. In an example in FIG. 7, the input image brightness Li3 changes from the first frame of the scan period St5 and the backlight brightness Lb3 changes from scanning of the second frame. Therefore, the average transmittance Tav3 in the scan period St5 changes in a manner similar to the average transmittance Tav2 in FIG. 5. Moreover, in the scan period St6, the input image brightness Li3 has not changed prior thereto, so that the average transmittance Tav3 in the scan period St6 also does not change.

The sixth row from the top in FIG. 7, the average image brightness Ld3 is the brightness of the frame displayed by the liquid crystal display apparatus 10*b*. The display image brightness Ld3 is the brightness by what transmitted the display panel device 104 of lights emitted by the backlight device 103, so that it takes a product of the backlight brightness Lb3 and the average transmittance Tav3.

Therefore, in an example in FIG. 7, the display image brightness Ld3 in the scan period St5 changes similarly to the display image brightness Ld2 in FIG. 5. Moreover, in the scan period St6, the display image brightness Ld in the scan period St6 does not change.

While the number of times of scans in the scan period during which the brightness of the backlight device 103 is changed is set to four times, it may be set to at least twice.

Moreover, while it has been explained, in the present embodiment, that the image analysis device 111*b* generates a histogram for each of the first to third frames of the scan period for the scan period during which the backlight device 103 is changed, it may be arranged for the image analysis device 111*b* to generate the histogram only for the first frame within the scan period in the same manner as the image analysis device 111 in FIG. 1. Moreover, in this case, in a manner similar to the backlight brightness calculation device 112 in FIG. 1, it may be arranged for the backlight device calculation device 112*b* to calculate the target brightness only once during the scan period and for the backlight brightness determination device 114*b* to calculate the control brightness using the target brightness.

Moreover, while it has been explained, in the present embodiment, that the image data I are input even during the retention period, it may be arranged for the image data I to be input only during the scan period and to be not input during the retention period, or for only some signals such as a vertical synchronization signal, etc. for example, of the image data I to be input during the retention period.

Furthermore, while all frames in each of the scan periods are desirably the same images in the image data I, as long as differences among them do not necessitate changing the backlight brightness, they do not have to be the same.

Furthermore, the image analysis device 111*b* is reported on whether to change the brightness of the backlight device 103 from the backlight brightness determination device 114*b* in the present embodiment, it may be arranged for whether to change the brightness of the backlight device 103 to be reported from a different device or to be determined by the image analysis device 111*b*. For example, four frames of the image data I are input successively when the brightness of the backlight device 103 is changed, while, when it is not changed, it may be arranged to determine whether to change the brightness of the backlight device 103 in accordance with whether the second frame of the image data is input within a predetermined time after the first frame is input.

Alternatively, it may be determined that the brightness of the backlight device 103 is changed when a change in the number of pixels from the previous frame is at least a threshold value, or it may be determined that the brightness of the backlight device 103 is changed when a check sum which is calculated for each frame changes.

Moreover, while the scan period is set to what corresponds to one frame when the backlight brightness is not changed in the present embodiment, it is set to what corresponds to two frames or more when it is shorter than the scan period when the backlight brightness is changed.

Scanning is performed four times in the scan period during which the brightness of the backlight device 103 is changed as shown in FIG. 7 in the present embodiment, so that the backlight brightness may be changed gradually for each of the second scan and beyond. This prevents the brightness of the backlight from rapidly changing, making it possible to prevent the viewer from feeling flickering.

Moreover, a time period in which the backlight brightness does not match the target brightness may be contained to within the scan period. Therefore, an inappropriate state in which the image quality is being degraded due to the brightness of the backlight being too low, or the power consumption being large due to the brightness of the backlight being too high may be contained to a short time which is within the scan period.

Moreover, the number of times of scans is set to a plurality only during the scan period during which the brightness of the backlight device 103 is changed, making it possible to suppress an increase of the number of times of scans and to suppress power consumption.

Fourth Embodiment

A fourth embodiment described below is an embodiment in which polarity inversion between frames is not performed. While the liquid crystal display apparatus 10*b* according to the present embodiment is similar to the liquid crystal display apparatus 10*b*, it is different therefrom in that the image conversion device 113*b* inverts the polarity specified for the source driver device 106 for each period, not between the frames within the scan period.

Figure 8:
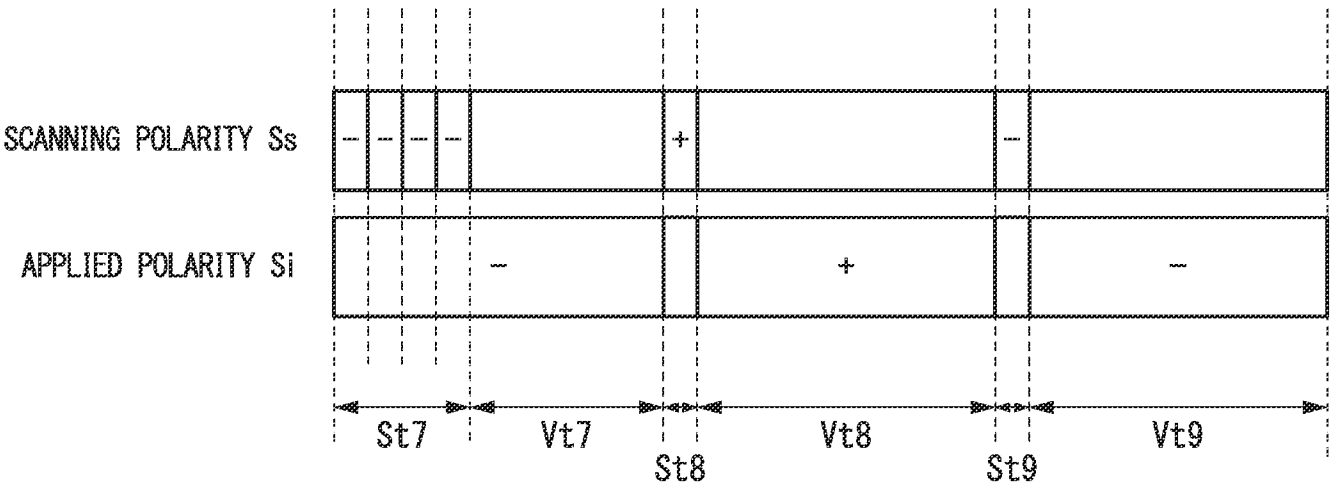
FIG. 8 is a time chart for explaining polarity inversion according to a fourth embodiment.

FIG. 8 is a time chart for explaining polarity inversion according to the present embodiment. In FIG. 8, St7, St8, and St9 are scan periods, while Vt7, Vt8, and Vt9 are retention periods.

The scan period St7 is a scan period during which the brightness of the backlight device 103 is changed and the number of times of scans is four. The scan periods St8 and St9 are scan periods during which the brightness of the backlight device 103 is changed and the number of times of scans is one. The length of the retention period Vt7 corresponds to six frames, while the length of the retention periods Vt8 and Vt9 corresponds to nine frames.

The upper row in FIG. 8 shows a scanning polarity Ss which is instructed to the source driver device 106 by the image conversion device 113. In an example in FIG. 8, the image conversion device 113 instructs the negative polarity for all of the four scans in the scan period St7. In the following scan period St8, the polarity is inverted, so that the image conversion device 113 instructs the positive polarity. Moreover, in the following scan period St9, the polarity is inverted, so that the image conversion device 113 instructs the negative polarity.

The lower row in FIG. 8 shows a polarity applied to the liquid crystal in the display panel device 104 when scanning with the polarity shown in the upper row. The polarity applied to the liquid crystal in the retention period will be the polarity of the immediately preceding scan. Thus, the polarity applied to the liquid crystal is the negative polarity in the scan period St7 and the retention period Vt7, being the first period in FIG. 8. Moreover, it is the positive polarity in the scan period St7 and the retention period Vt8, being the second period, Furthermore, it is the negative polarity in the scan period St9 and the retention period Vt9, being the third period.

In this way, the polarity inversion may be performed for each period, not during the scan period, to set the time length during which the positive polarity is applied to the liquid crystal and the time length during which the negative polarity is applied thereto to be the same.

Even in the liquid crystal display apparatus 10 according to the first embodiment and the liquid crystal display apparatus 10*a* according to the second embodiment, it is desirable to invert the polarity to be specified for the source driver device 106 for each period, not between frames, during the scan period. This makes it possible to set the time length during which the positive polarity is applied to the liquid crystal and the time length during which the negative polarity is applied thereto to be the same.

Fifth Embodiment

Figure 9:
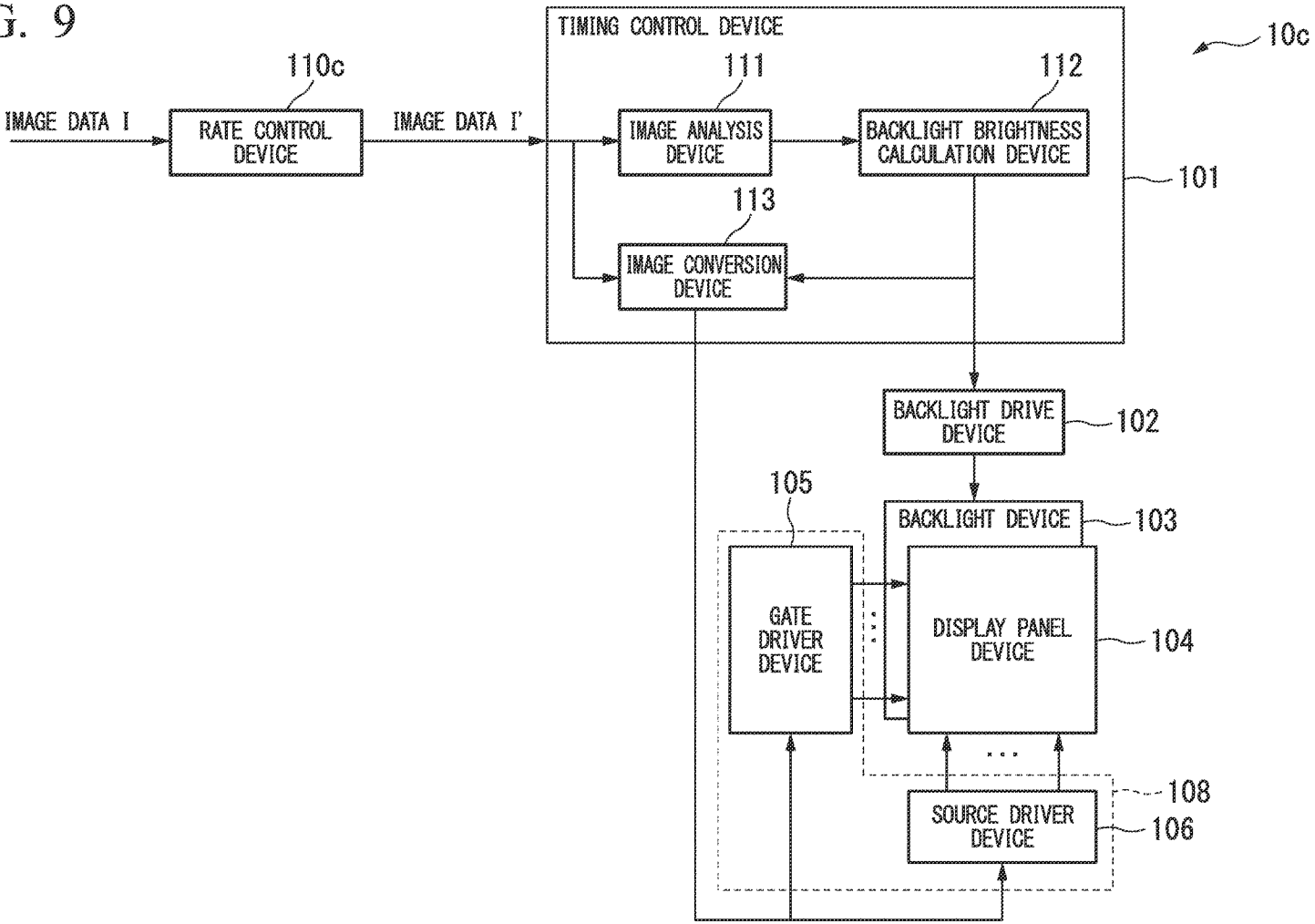
FIG. 9 is a schematic block diagram illustrating a configuration of a liquid crystal display apparatus 10*c* according to a fifth embodiment of the present invention.

A below-described fifth embodiment is an addition of a rate control device 110*c* to the liquid crystal display apparatus 10 in FIG. 1. As shown in FIG. 9, the rate control device 110*c* is provided at the pre-stage of the timing control device 101. The rate control device 110*c*, which includes a frame memory, causes image data I input to be stored into the frame memory, and generates image data I' in alignment with the timing in which the display panel device 104 is scanned to input the generated image data I' to the timing control device 101.

In other words, the rate control device 110*c* generates image data such that two frames are included therein in each of the scan periods in the image data I' and inputs the generated image data into the timing control device 101. While it is desirable that the two frames of the image data are the same, they do not have to be the same as long as the difference thereof does not necessitate changing the backlight brightness. It may be or may not be arranged for the image data to be included therein even in the retention period.

This makes it possible for the liquid display device 10*c* to handle, as image data I, those in which the rate of scanning is different from that of the rate of scanning of the display panel device 104. For example, the image data I may be input only when there is a change in the image, it may be of a fixed rate such as 60 fps, etc., or it may be input for one frame in one period including the scan period and the retention period.

Sixth Embodiment

Figure 10:
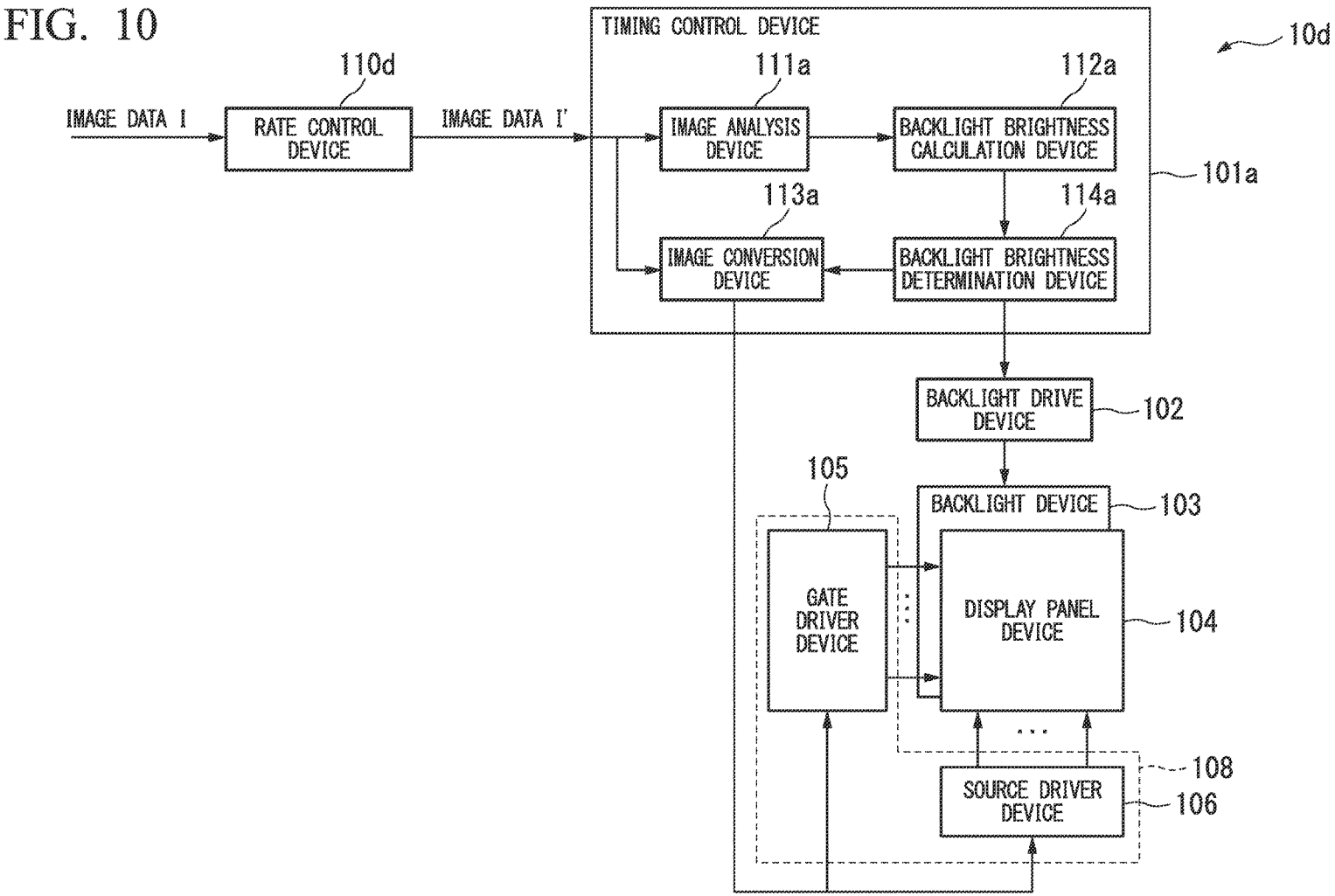
FIG. 10 is a schematic block diagram illustrating a configuration of a liquid crystal display apparatus 10*d* according to a sixth embodiment of the present invention.

A below-described sixth embodiment is an addition of a rate control device 110*d* to the liquid crystal display apparatus 10*a* in FIG. 4. As shown in FIG. 10, the rate control device 110*d* is provided at the pre-stage of the timing control device 101*a*. The rate control device 110*d*, which includes a frame memory, causes image data I input to be stored into the frame memory, and generates image data I' in alignment with the timing in which the display panel device 104 is scanned to input the generated image data I' to the timing control device 101*a*.

In other words, the rate control device 110*d* generates four frames of image data with reference to the image data I stored in the frame memory in each of the scan periods as the image data I' and inputs the generated image data into the timing control device 101*a*.

While it is desirable that the four frames of the image data are the same, they do not have to be the same as long as the difference thereof does not necessitate changing the backlight brightness.

This makes it possible for the liquid display device 10*d* to handle, as image data I, what is different from the rate of scanning of the display panel device 104. For example, the image data I may be input only when there is a change in the image, it may be of a fixed rate such as 60 fps, etc., or it may be input for one frame in one period including the scan period and the retention period.

Seventh Embodiment

Figure 11:
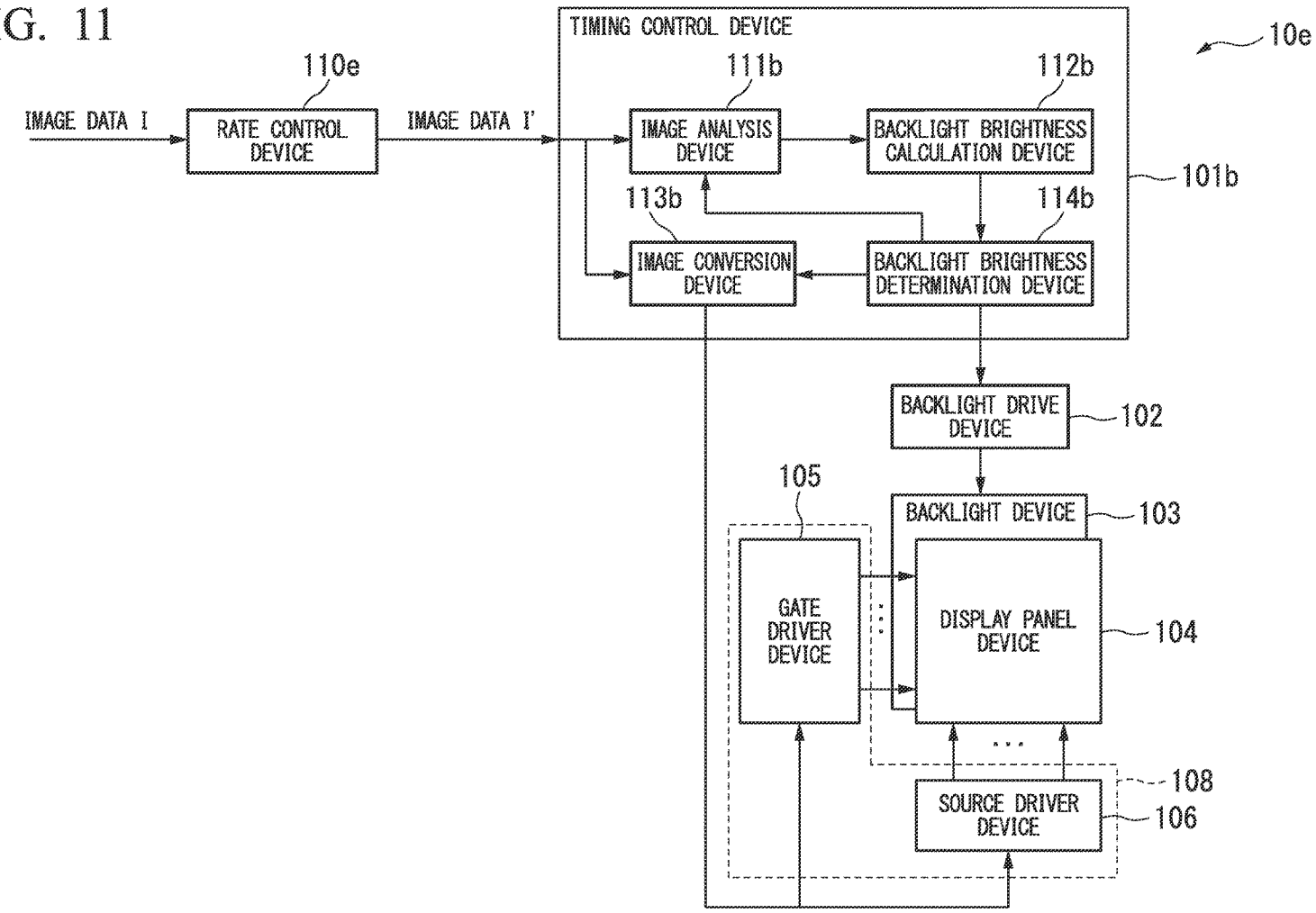
FIG. 11 is a schematic block diagram illustrating a configuration of a liquid crystal display apparatus 10*e* according to a seventh embodiment of the present invention.

A below-described seventh embodiment is an addition of a rate control device 110*e* to the liquid crystal display apparatus 10*a* in FIG. 6. As shown in FIG. 11, the rate control device 110*e* is provided at the pre-stage of the timing control device 101*b*. The rate control device 110*e*, which includes a frame memory, causes image data I input to be stored into the frame memory, and generates image data I' in alignment with the timing in which the display panel device 104 is scanned to input the generated image data I' to the timing control device 101*b*.

In other words, the rate control device 110*e*, with reference to the image data I stored in the frame memory in each of the scan periods as the image data I', generates four frames of image data when a change of the backlight brightness is necessary and inputs the generated image data into the timing control device 101*a* and generates one frame of image data when a change of the backlight brightness is not necessary and inputs the generated image data into the timing control device 101*b*. While it is desirable that the four frames of the image data are the same, they do not have to be the same as long as the difference thereof does not necessitate changing the backlight brightness. Moreover, the rate control device 110*e* may determine, in the same manner as the timing control device 101*b*, whether a change in the backlight brightness is necessary.

In the same manner as the rate control device 110*d*, the rate control device 110*e* may always generate four frames of image data in one period which includes the scan period and the retention period. Alternatively, the four frames of image data are generated when there is a change in the image from the previous scan period, while one frame of image data is produced when there is no change therein.

This makes it possible for the liquid display device 10*e* to handle, as the image data I, what is different from the rate of scanning of the display panel device 104. For example, the image data I may be input only when there is a change in the image, it may be of a fixed rate such as 60 fps, etc., or it may be input for one frame in one period including the scan period and the retention period.

While a color display liquid crystal display apparatus is exemplified in the above-described respective embodiments, it may be a monochrome display liquid crystal display apparatus or a field sequential liquid crystal display apparatus. In this case, the display panel device 104, which does have a color filter, controls the transmittance for each pixel. Moreover, the backlight device 103 emits a light of a display color for the monochrome display, while it emits a light of one of three primary colors of light for the field sequential technique.

Moreover, while it has been explained, in the above-described respective embodiments, that the length of one period which is an addition of the scan period and the retention period is constant, it may be varied.

Furthermore, while the liquid display device in which the display panel device 104 has a liquid crystal panel has been exemplified in the above-described embodiments, the present invention may be applied to a display device other than the liquid display device as long as it includes a backlight lighting device and it can perform pausing driving.

As a semiconductor material of the liquid crystal panel included in the display panel device 104 in the above-described respective embodiments, oxide semiconductors may be used. A semiconductor layer using an oxide semiconductor (that is called an oxide semiconductor layer) may be an In—Ga—Zn—O semiconductor layer, for example. The oxide semiconductor layer includes an In—Ga—Zn—O semiconductor, for example. Here, the In—Ga—Zn—O semiconductor is a ternary oxide of In, Ga, and Zn, where the ratio (composition ratio) of Ga and Zn is not specifically limited, and may include In:Ga:Zn=2:2:1, In:Ga:Zn=1:1:1, In:Ga:Zn=1:1:2, etc., for example. In the present embodiment, a film of an In-GA-Zn—O semiconductor containing In, Ga, and Zn at the ratio of 1:1:1 is used.

A TFT (thin film transistor) having the In—Ga—ZN—O semiconductor layer has a high mobility (over 20 times relative to a-SiTFT) and a low leakage current (less than one hundredth relative to a-SiTFT), so that it is preferably used as a drive TFT and a pixel TFT. A TFT having the In—Ga—Zn—O semiconductor layer can be used to substantially reduce power consumption of the liquid display device.

The In—Ga—Zn—O semiconductor may be amorphous, may have a crystalline substance portion, or may have a crystallizing property. A crystalline In—Ga—Zn—O semiconductor is preferably a crystalline In—Ga—Zn—O semiconductor whose c axis is oriented generally perpendicular to the layer face. Such a crystalline structure of the In—Ga—Zn—O semiconductor is disclosed in JP2012-134475A for example. For reference, the whole disclosure of the JP2012-134475A is incorporated by reference in the present specification.

The oxide semiconductor layer may contain oxide semiconductors other than the In—Ga—ZN—O semiconductor. For example, it may contain a Zn—O semiconductor (ZnO), an In—Zn—O semiconductor (IZO (registered copyright)), a ZN—Ti—O semiconductor (ZTO), a Cd—Ge—O semiconductor, a Cd—Pb—O semiconductor, a CdO (cadmium oxide), a Mg—Zn—O semiconductor, an In—Sn—Zn—O semiconductor (In2O3-SnO2-ZnO, for example), an In—Ge—Sn—O semiconductor, etc.

Moreover, the timing control device 101 in FIG. 1, the timing control device 101*a* in FIG. 4, and the timing control device 101*b* in FIG. 6 may be implemented as an integrated circuit such as an LSI (large scale integration), etc. The individual functions which make up the timing control devices 101, 101*a*, and 101*b* may be individually made into a processor, or some or all thereof may be integrated to make the integrated result into a processor. Moreover, the technique of circuit integration is not limited to the LSI, so that it may be implemented with a dedicated circuit or a generic processor.

Moreover, when the above-described timing control devices 101, 101*a*, and 101*b* are implemented as the integrated circuits, any of the other devices such as the rate control device 110*c*, 110*d*, 110*e*, the source driver device 106, the gate driver device 105, etc., may be included in the semiconductor circuit.

While embodiments of the present invention have been detailed in the above with reference to the drawings, specific configurations are not limited to these embodiments, so that they may include design changes within the scope not departing from the gist of the present invention.

(1) The present invention has been conceived to solve the above-described problems. In an embodiment of the present invention is provided a display apparatus, including, a backlight device which emits a light; a backlight drive device which drives the backlight device; a display panel device which controls a transmittance of the light emitted by the backlight device at least for each pixel; a display panel drive device which scans the display panel device to cause the transmittance to be controlled; a timing control device which controls timing at which the display panel drive device scans the display panel device and a brightness of the backlight drive device, wherein a scan period during which the display panel drive device scans the display panel device and a retention period during which the display panel drive device does not scan the display panel device alternate; and the timing control device causes the display panel drive device to scan the display panel device a plurality of times in the scan period when it changes at least the brightness of the backlight device.

In this way, at the time of one of the second-and-thereafter scans within the scan period, the backlight brightness may be changed and the transmittance of the display panel device may be made suitable for the backlight brightness. Thus, an occurrence of the inappropriate brightness such that the backlight brightness does not match the target brightness and the picture quality is being degraded due to the backlight brightness being too low, or the power consumption is large due to the backlight brightness being too high may be contained to within a very short time, such as only during the scan period.

(2) Moreover, in another embodiment of the present invention, the display apparatus as recited in (1) is provided, wherein the timing control device controls the backlight drive device such that the brightness of the backlight device does not change at the time of a first scan and changes at the time of a second scan of the plurality of times of scans.

This may make the transmittance of the display panel device 104 suitable for the backlight transmittance at the time of the second scan during the scan period. Thus, a time period in which the backlight brightness does not match the target brightness may be contained to within the first scan and an occurrence of the inappropriate brightness such that the picture quality is being degraded due to the backlight brightness being too low, or the power consumption is large due to the backlight brightness being too high may be contained to within a very short time, such as only during the scan period.

(3) Furthermore, in a further embodiment of the present invention, the display apparatus as recited in (1) is provided, wherein the timing control device controls the backlight drive device such that the brightness of the backlight device changes gradually in the plurality of time of scans.

This may eliminate a rapid change of the backlight brightness to prevent the viewer from feeling the flickering.

Moreover, a time period in which the backlight brightness does not match the target brightness may be contained to within the scan period. Thus, an occurrence of the inappropriate state such that the picture quality is being degraded due to the backlight brightness being too low, or the power consumption is large due to the backlight brightness being too high may be contained to within a short time, such as during the scan period.

(4) Moreover, in a yet further embodiment of the present invention, the display apparatus as recited in (1) is provided, wherein the timing control device controls the display panel drive device such that the display panel device is scanned the number of times that is less than the plurality of times in the scan period when the brightness of the backlight device is not changed.

This may cause an increase of the number of times of scans and power consumption to be suppressed.

(5) Furthermore, in another embodiment of the present invention, the display apparatus as recited in (4) is provided, wherein the timing control device sets a length of a period including the scan period and the following retention period to be constant.

(6) Moreover, in a further embodiment of the present invention, the display apparatus as recited in (4) is provided, wherein the timing control device controls the display panel drive device such that polarity conversion is performed for each period including a scan period and the following retention period and is not performed for each scan during the plurality of times of scans.

This may set the time length during which the positive polarity is applied to the liquid crystal and the time length during which the negative polarity is applied thereto to be the same.

(7) Furthermore, in a further embodiment of the present invention, the display apparatus as recited in any one of (1) to (6) is provided, wherein the display panel device has a thin film transistor; and the thin film transistor is made of an oxide semiconductor.

(8) Moreover, in a yet further embodiment of the present invention, the display apparatus as recited in (7) is provided, wherein the oxide semiconductor includes In, Ga, Zn, and O.

(9) Furthermore, in another embodiment of the present invention, the display apparatus as recited in (8) is provided, wherein the oxide semiconductor including In, Ga, Zn, and O has a crystallizing property.

(10) Moreover, in a further embodiment of the present invention is provided a display control circuit which controls a backlight drive device which drives a backlight device which emits a light and a display panel drive device which scans the display panel device to cause an amount of transmittance of the light emitted by the backlight device to be controlled, the display control circuit further including a timing control device which causes the display panel drive device to scan the display panel device a plurality of times in a scan period in which the display panel drive device scans the display panel device when at least the brightness of the backlight device is changed, wherein the scan period and a retention period in which the display panel drive device does not scan the display panel device alternate.

This makes it possible to change the backlight brightness at the time of one of the second-and-beyond scans within the scan period and set the transmittance of the display panel device to be suitable for the backlight brightness. Thus, an occurrence of the inappropriate brightness such that the backlight brightness does not match the target brightness and the picture quality is being degraded due to the backlight brightness being too low, or the power consumption is large due to the backlight brightness being too high may be contained to within a very short time, such as only during the scan period.

INDUSTRIAL APPLICABILITY

One embodiment of the present invention may be applied to display devices which need to contain an occurrence of the inappropriate brightness, such as flickering at the time of pausing driving.

DESCRIPTION OF REFERENCE NUMERALS

10, 10*a*, 10*b*, 10*c*, 10*d*, 10*e* liquid crystal display apparatus
101, 101*a* timing control device
102 backlight drive device
103 backlight device
104 display panel device
105 gate driver device
106 source driver device
107 display panel drive device
111, 111*a*, 111*b* image analysis device
112, 112*a*, 112*b* backlight brightness calculation device
113, 113*a*, 113*b* image conversion device
114*a*, 114*b* backlight brightness determination device
110*c*, 110*d*, 110*e* rate control device

The invention claimed is:

1. A display apparatus, comprising:

a backlight device configured to emit a light;

a backlight drive device configured to drive the backlight device;

a display panel device configured to control a transmittance of the light emitted by the backlight device at least for each pixel;

a display panel drive device configured to scan the display panel device to cause the transmittance to be controlled;

a timing control device configured to control timing at which the display panel drive device scans the display panel device and a brightness of the backlight device, wherein a scan period during which the display panel drive device scans the display panel device and a retention period during which the display panel drive device does not scan the display panel device alternate, the timing control device is configured to cause the display panel drive device to scan the display panel device a plurality of times in the scan period when it changes at least the brightness of the backlight device, the timing control device is configured to cause the display panel drive device to scan the display panel device four times during the scan period when the brightness of the backlight device is changed, and the timing control device is configured to cause the display panel drive device to scan the display panel device one time during the scan period when the brightness of the backlight device is not changed.

2. The display apparatus as claimed in claim 1, wherein the timing control device is configured to control the backlight drive device such that the brightness of the backlight device changes gradually in the plurality of time of scans.

3. The display apparatus as claimed in claim 1, wherein the timing control device is configured to set a length of a period including the scan period and the following retention period to be constant.

4. The display apparatus as claimed in claim 1, wherein the timing control device is configured to control the display panel drive device such that polarity conversion is performed for each period including a scan period and the following retention period and is not performed for each scan during the plurality of times of scans.

5. The display apparatus as claimed in claim 1, wherein the display panel device is configured to have a thin film transistor; and the thin film transistor is configured to include an oxide semiconductor.

6. The display apparatus as claimed in claim 5, wherein the oxide semiconductor is configured to include In, Ga, Zn, and O.

7. The display apparatus as claimed in claim 6, wherein the oxide semiconductor configured to include the In, Ga, Zn, and O is configured to have a crystallizing property.

8. The display apparatus as claimed in claim 1, wherein:

the timing control device includes:

an image analysis device that calculates a histogram of grey scale values of a pixel for a first frame of the scan period of an image data input to the display apparatus; and a backlight brightness calculation device that refers to the histogram calculated by the image analysis device and calculates a target brightness of the backlight device, and the timing control device determines, based on the target brightness calculated by the backlight brightness calculation device, whether or not to change the brightness of the backlight device.

9. The display apparatus as claimed in claim 1, wherein:

the timing control device causes the display panel drive device to scan the display panel device the plurality of times by causing the display panel drive device to cause a first scan and a second scan during the scan period, the first scan is for a first frame of the scan period of an image data input to the display apparatus, and the second scan is for a second frame which follows the first frame.

10. A display control circuit configured to control a backlight drive device configured to drive a backlight device which emits a light and a display panel drive device configured to scan a display panel device to cause an amount of transmittance of the light emitted by the backlight device to be controlled, the display control circuit comprising:

a timing control device configured to cause the display panel drive device to scan the display panel device a plurality of times in a scan period in which the display panel drive device scans the display panel device when at least a brightness of the backlight device is changed, wherein the scan period and a retention period in which the display panel drive device does not scan the display panel device alternate, the timing control device is configured to cause the display panel drive device to scan the display panel device four times during the scan period when the brightness of the backlight device is changed, and the timing control device is configured to cause the display panel drive device to scan the display panel device one time during the scan period when the brightness of the backlight device is not changed.

* * * * *